US012564263B2

(12) United States Patent
Yang

(10) Patent No.: US 12,564,263 B2
(45) Date of Patent: Mar. 3, 2026

(54) STADIUM SEAT CUSHION

(71) Applicant: Miao Yang, Laohekou (CN)

(72) Inventor: Miao Yang, Laohekou (CN)

( * ) Notice: Subject to any disclaimer, the term of this patent is extended or adjusted under 35 U.S.C. 154(b) by 0 days.

(21) Appl. No.: 19/283,085

(22) Filed: Jul. 28, 2025

(65) Prior Publication Data

US 2025/0351965 A1 Nov. 20, 2025

(51) Int. Cl.

| | |
|---|---|
| ***A47C 1/16*** | (2006.01) |
| ***A47C 7/02*** | (2006.01) |
| ***A47C 7/62*** | (2006.01) |

(52) U.S. Cl.

CPC ..... *A47C 1/16* (2013.01); *A47C 7/0213* (2018.08); *A47C 7/622* (2018.08)

(58) Field of Classification Search

CPC ..... A47C 1/16; A47C 7/0213; A47C 7/021; A47C 7/622; A47D 1/103

USPC ..... 297/228.13, 252

See application file for complete search history.

(56) References Cited

U.S. PATENT DOCUMENTS

| | | | | |
|---|---|---|---|---|
| 116,934 | A * | 7/1871 | Cutter | A47C 1/16 297/352 |
| 2,046,198 | A * | 6/1936 | Letts | A47C 1/16 297/252 |
| 2,466,361 | A * | 4/1949 | Bjornskaas | A47C 1/16 297/252 |
| 2,736,365 | A * | 2/1956 | Hines | A47C 1/16 297/352 |
| 3,066,980 | A * | 12/1962 | Clute | A47C 1/16 297/352 |
| 7,774,880 | B1 | 8/2010 | Botts | |
| 9,271,575 | B1 * | 3/2016 | Leff | A47C 7/62 |
| 2005/0051403 | A1 * | 3/2005 | Hankins | A47C 1/16 383/4 |
| 2009/0079244 | A1 * | 3/2009 | Kelleher | A47C 1/16 297/257 |

FOREIGN PATENT DOCUMENTS

| | | |
|---|---|---|
| CN | 222264833 U | 12/2024 |
| CN | 222917204 U | 5/2025 |

* cited by examiner

*Primary Examiner* — Milton Nelson, Jr.

(57) ABSTRACT

A stadium seat cushion including a seat cushion main body and a backrest is disclosed. The seat cushion main body has filling material inside. The backrest is pivotally connected to the seat cushion main body. The backrest includes a support state and a folded state. When the backrest is in the folded state, rotate the backrest away from the seat cushion main body, it enters the support state. When the backrest is in the support state, rotate the backrest to a position flush with the seat cushion main body, thereby entering the folded state.

10 Claims, 11 Drawing Sheets

STADIUM SEAT CUSHION

TECHNICAL FIELD

The disclosure relates to the technical field of seat cushions, in particular to a stadium seat cushion.

BACKGROUND ART

Seat cushions are auxiliary products laid on seating surfaces to enhance comfort, effectively improving the support and pressure distribution. It is a practical item widely used in offices, homes, and leisure entertainment. Especially in stadiums, spectators need to sit on the stadium bleachers for long periods to watch sports events. However, stadium bleachers are generally hard, so prolonged sitting causes fatigue and discomfort. Existing seat cushions commonly adopt multi-material composite designs, such as memory foam, latex, gel, etc., offering different levels of softness/hardness, breathability, and support characteristics. Users can choose suitable types of seat cushions according to their needs to meet usage requirements in different scenarios, thereby improving comfort.

However, existing stadium seat cushions generally only have a single layer at the bottom, providing limited comfortable space and lacking additional functions. For example, home-use seat cushions have stronger wrapping properties and can provide larger comfortable space. However, home-use seat cushions are difficult to transport, so moving them to stadiums for use would consume significant manpower and material resources.

SUMMARY

The disclosure provides a stadium seat cushion to solve the problems in the prior art of insufficient comfort in stadium seat cushions and difficulty in transporting home-use seat cushions.

A stadium seat cushion including a seat cushion main body and a backrest is disclosed. The seat cushion main body has filling material inside. The backrest is pivotally connected to the seat cushion main body. The backrest includes a support state and a folded state. When the backrest is in the folded state, rotating the backrest away from the seat cushion main body causes it to enter the support state. When the backrest is in the support state, rotating the backrest to a position flush with the seat cushion main body causes it to enter the folded state.

According to the stadium seat cushion provided by the disclosure, it further comprises a support frame. The support frame is connected to the lower surface of the seat cushion main body.

According to the stadium seat cushion provided by the disclosure, the seat cushion main body comprises a cover and a connecting member. The cover is detachably connected to the support frame and the connecting member is provided at the rear end of the seat cushion main body. The backrest is pivotally connected to the seat cushion main body through the connecting member.

According to the stadium seat cushion provided by the disclosure, it further comprises a reinforcing plate. One end of the reinforcing plate is connected to the backrest, and in the support state, and the other end of the reinforcing plate abuts against the support frame.

According to the stadium seat cushion provided by the disclosure, it further comprises a shoulder strap and a cushion pad. The shoulder strap is connected to the seat cushion main body, and the cushion pad is sleeved on the shoulder strap.

According to the stadium seat cushion provided by the disclosure, it further comprises a plurality of anti-slip buckles. The plurality of anti-slip buckles are detachably connected to the lower surface of the seat cushion main body.

According to the stadium seat cushion provided by the disclosure, it further comprises a storage bag. The storage bag is installed at the front of the seat cushion main body, and the storage bag has a rotational degree of freedom relative to the seat cushion main body.

According to the stadium seat cushion provided by the disclosure, the storage bag comprises a water bottle pocket and a messenger bag.

According to the stadium seat cushion provided by the disclosure, it further comprises a hook. The hook is connected below the seat cushion main body, for fixing the seat cushion main body.

According to the stadium seat cushion provided by the disclosure, the hook has a rotational degree of freedom relative to the seat cushion main body.

According to the stadium seat cushion provided by the disclosure, the storage bag is made of flexible material.

According to the stadium seat cushion provided by the disclosure, it further comprises a first connecting strap and a second connecting strap. The first connecting strap and the second connecting strap are respectively connected to the two ends below the seat cushion main body. The first connecting strap and the second connecting strap are detachably connected to each other. The support frame is provided between the seat cushion main body and the first connecting strap as well as the second connecting strap.

According to the stadium seat cushion provided by the disclosure, the first connecting strap is provided with a first fixing strip and a second fixing strip. The second connecting strap is provided with a first connecting strip. The first connecting strip is detachably connected to the first fixing strip. The storage bag is provided with a second connecting strip, and the second connecting strip is detachably connected to the second fixing strip.

The stadium seat cushion provided by the disclosure comprises a seat cushion main body. The interior of the seat cushion main body is filled with elastic filling material, so that the seat cushion main body can deform when subjected to pressure, absorbing buffering force. Meanwhile, after deformation, the contact area can be increased, thereby reducing pressure intensity and improving comfort. In the disclosure, a backrest is also connected to the seat cushion main body, and the backrest is pivotally connected to the seat cushion main body. When facing a stadium environment, the seat cushion main body can be placed on the stadium bleachers, and then the backrest can be rotated away from the seat cushion main body to unfold it into the support state. At this time, the seat cushion main body isolates the hard surface of the bleachers, while the backrest provides back support, creating a larger comfortable space and improving overall comfort. Moreover, when needing to leave the stadium, the backrest can be rotated towards the seat cushion main body, bringing the backrest flush with the seat cushion main body, thereby entering the folded state, which facilitates carrying and transportation, reducing the manpower and material resources required for transporting.

DESCRIPTION OF THE ACCOMPANYING DRAWINGS

To more clearly illustrate the technical solutions of the disclosure or the prior art, the following will briefly introduce the drawings required for describing the embodiments or the prior art. Obviously, the drawings in the following description are some embodiments of the disclosure. For those of ordinary skill in the art, other drawings can be obtained based on these drawings without creative efforts.

DETAILED DESCRIPTION OF THE EMBODIMENTS

To make the objectives, technical solutions, and advantages of the disclosure clearer, the technical solutions in the disclosure will be described clearly and completely in conjunction with the accompanying drawings. Obviously, the described embodiments are part of the embodiments of the disclosure, rather than all of them. Based on the embodiments in the disclosure, all other embodiments obtained by those of ordinary skill in the art without creative effort shall fall within the protection scope of the disclosure.

Figure 1:
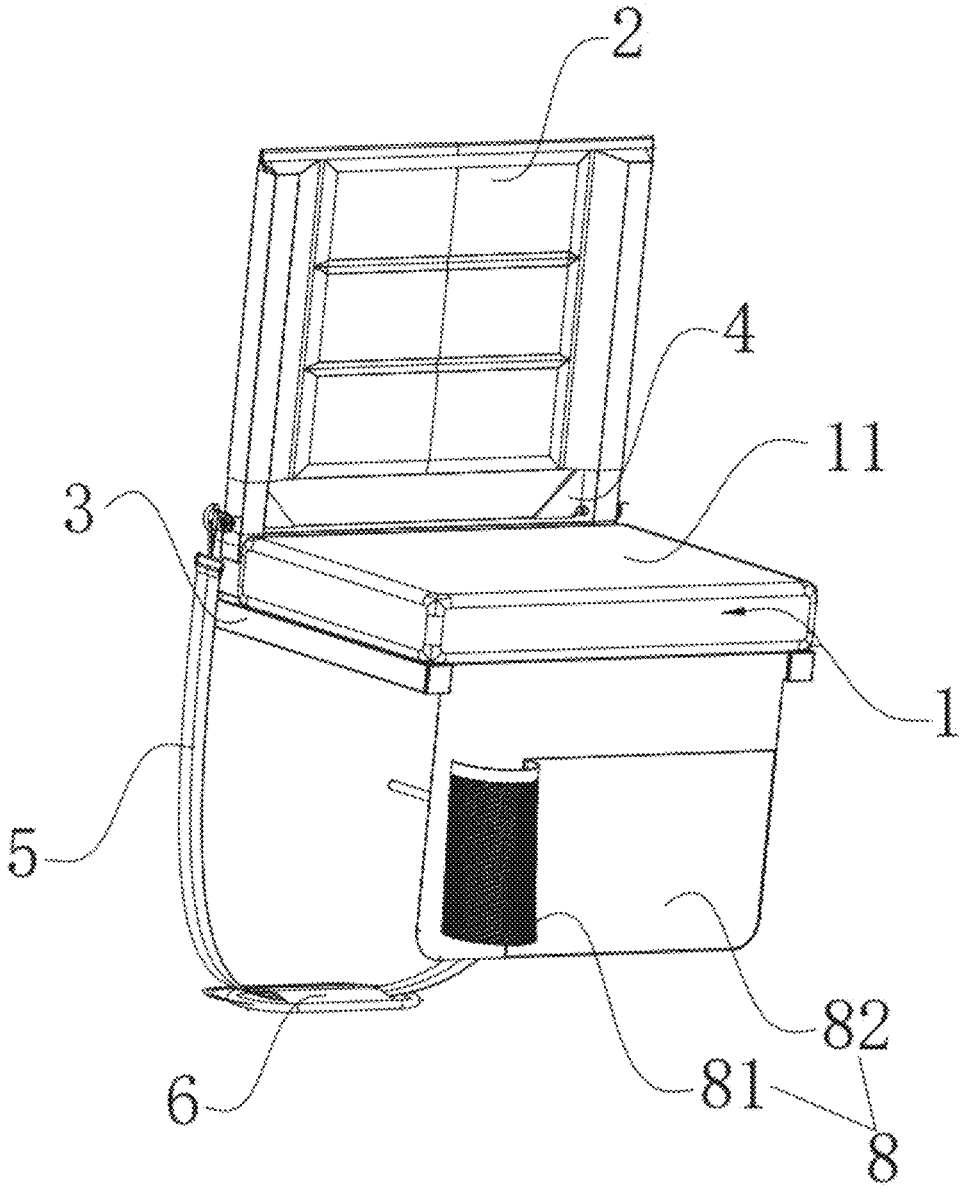
FIG. 1 is a schematic structural diagram of the stadium seat cushion provided by the disclosure.

The following describes a stadium seat cushion of the disclosure with reference to FIG. 1, it includes a seat cushion main body (1) and a backrest (2). The seat cushion main body (1) has filling material inside. The backrest (2) is pivotally connected to the seat cushion main body (1). The backrest (2) includes a support state and a folded state. Wherein, rotating the backrest (2) away from the seat cushion main body (1) causes it to enter the support state and rotating the backrest (2) to a position flush with the seat cushion main body (1) causes it to enter the folded state.

Referring to FIGS. 1 to 4, the seat cushion main body (1) provides bottom support, so it has filling material inside. When entering a stadium environment, users need to sit on the stadium bleachers for long periods. Due to factors such as the service life and structural strength of the bleachers, stadiums generally make the bleachers from hard materials. Moreover, the bleachers are typically benches, providing limited support range and only supporting the hips. Audiences sit on the benches to watch performances, which often last a long time. However, seats made of hard materials lack cushioning properties, causing localized compressive pain after prolonged sitting.

Therefore, this application uses the seat cushion main body (1) for cushioning. When audiences need to go to the stadium to watch a performance, they can carry the seat cushion main body (1) to the stadium in advance. Upon arrival, they take out the seat cushion main body (1) and place it on the stadium seat. When sitting, the audience sits on the seat equipped with the seat cushion main body (1). After sitting, the audience first contacts the seat cushion main body (1). With filling material inside, when the audience sits down, their weight presses down on the seat cushion main body (1). Under pressure, the filling material inside deforms, increasing the contact area and improving comfort. Moreover, the seat cushion main body (1) can deform according to the pressure distribution, making it fit the audience's hips more closely and further enhancing comfort.

In this application, the seat cushion main body (1) solves the problem of localized compressive pain caused by prolonged sitting on hard seats. However, the support range provided by the seat cushion main body (1) is limited. While it can alleviate pain, it cannot expand the support range. Therefore, this application also connects a backrest (2) to the seat cushion main body (1) to provide back support.

As shown in FIG. 1, it illustrates the backrest (2) in the support state. Both the backrest (2) and the seat cushion main body (1) are approximately rectangular plate-like shapes, connected along a common edge via a pivotal connection. Thus, in the support state, the backrest (2) and the seat cushion main body (1) form an unfolded configuration. Preferably, the angle between the backrest (2) and the seat cushion main body (1) in the support state is 90°, meaning they are perpendicular to each other. At this time, when the audience sits on the seat cushion main body (1), they can lean back, allowing the backrest (2) to support their back. Since the backrest (2) is in the support state, it can provide sufficient support force. Therefore, when the audience sits on the stadium seat cushion provided by this application, the seat cushion main body (1) provides support and improves comfort for the hips, while the backrest (2) provides support and improves comfort for the back. Thus, the combination of the backrest (2) and the seat cushion main body (1) expands the support range and enhances overall comfort.

When the audience finishes watching the game or performance and needs to leave the stadium, the audience can rotate the backrest (2) toward the seat cushion main body (1) until the backrest (2) and the seat cushion main body (1) are flush with each other, causing the backrest (2) to enter the folded state. When the backrest (2) enters the folded state, the backrest (2) and the seat cushion main body (1) transition from an unfolded to a flush position, reducing the overall volume and occupied space, making it more suitable for carrying. Simultaneously, the overall shape can fit the audience more closely, further enhancing portability. Therefore, rotating the backrest (2) to the folded state solves the problem of difficult transportation of traditional seats.

In this application, comfort is first enhanced by connecting a backrest (2) to the seat cushion main body (1). Then, the seat cushion main body (1) and the backrest (2) are pivotally connected. By rotating the backrest (2) to the folded state flush with the seat cushion main body (1), portability is improved. This addresses both the problem of insufficient comfort in existing seat cushions and the difficulty in transporting seats in the prior art.

Furthermore, although the provided product is a stadium seat cushion, its usage scenarios are not limited to stadiums. Due to its excellent portability, it can be carried to various environments. Moreover, since the stadium seat cushion comprises the seat cushion main body (1) and the backrest (2), providing support in two orientations, it can still be used in scenarios without seats, such as outdoor camping. During outdoor camping, the seat cushion main body (1) can be placed directly on grass or other surfaces. The cooperation between the seat cushion main body (1) and the backrest (2) provides sufficient support range. In other scenarios, such as parks, the same method can be applied. For example, placing the seat cushion main body (1) on open ground, grass, or park benches achieves the same effect. Therefore, the usage environment is not restricted here.

In one embodiment, it further comprises a support frame (3). The support frame (3) is connected to the lower surface of the seat cushion main body (1) and is fixedly connected to it. Please refer to FIGS. 1 to 4 together. A support frame (3) is connected to the bottom of the seat cushion main body (1). The support frame (3) comprises two parallel and symmetrically arranged longitudinal beams, with multiple transverse beams spaced apart between them. The arrangement of transverse beams not only strengthens the support frame (3) but also saves material due to the spacing. After connecting the transverse beams to the longitudinal beams, a complete support frame (3) is formed. Since most seat cushion main bodies (1) are square-shaped, the support frame (3) in this embodiment is also square-shaped to better fit the human body form.

Furthermore, because the seat cushion main body (1) has filling material inside, it deforms under pressure. If only the seat cushion main body (1) is used for support, there is a risk of collapse of the filling material under significant loads. Additionally, horizontal shear forces generated by user movement (e.g., approximately 200 N when standing up) are transmitted downward through the support frame (3), preventing delamination of the filling material. Therefore, in this embodiment, the overall structural strength is enhanced by adding the support frame (3) below the seat cushion main body (1), enabling it to handle significant loads. Meanwhile, the seat cushion main body (1) is positioned above, so the part in contact with the user remains elastic, maintaining sufficient comfort.

In this embodiment, the arrangement of the support frame (3) improves the overall structural strength without affecting comfort, enabling it to handle significant loads and increasing applicability.

In one embodiment, the seat cushion main body (1) comprises a cover (11) and a connecting member (12). The cover (11) is detachably connected to the support frame (3). The connecting member (12) is provided at the rear end of the seat cushion main body (1). The backrest (2) is pivotally connected to the seat cushion main body (1) via the connecting member (12).

Figure 5:
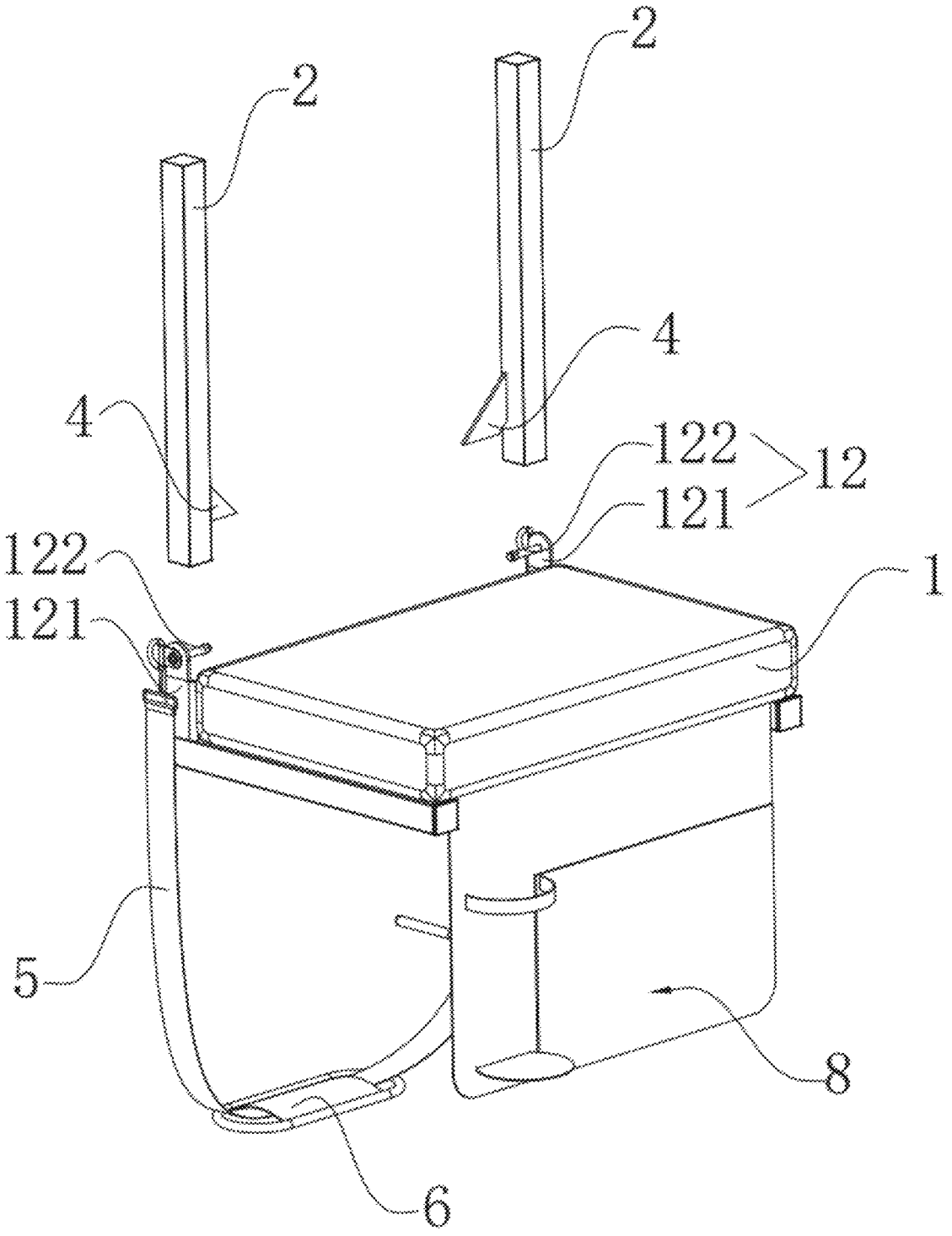
FIG. 5 is an exploded view of the stadium seat cushion provided by the disclosure.

As shown in FIG. 5, the outermost layer of the seat cushion main body (1) is the cover (11). The cover (11) wraps and protects the filling material inside. Preferably, the cover (11) is made of polyester fabric, which is fade-resistant, easy to clean, and prevents water accumulation or accidental spills. Since the cover (11) is the outermost layer, it frequently contacts the external environment. Therefore, it is susceptible to contamination by external pollutants. If contaminated, spot cleaning with a damp cloth can be performed.

Figure 7:
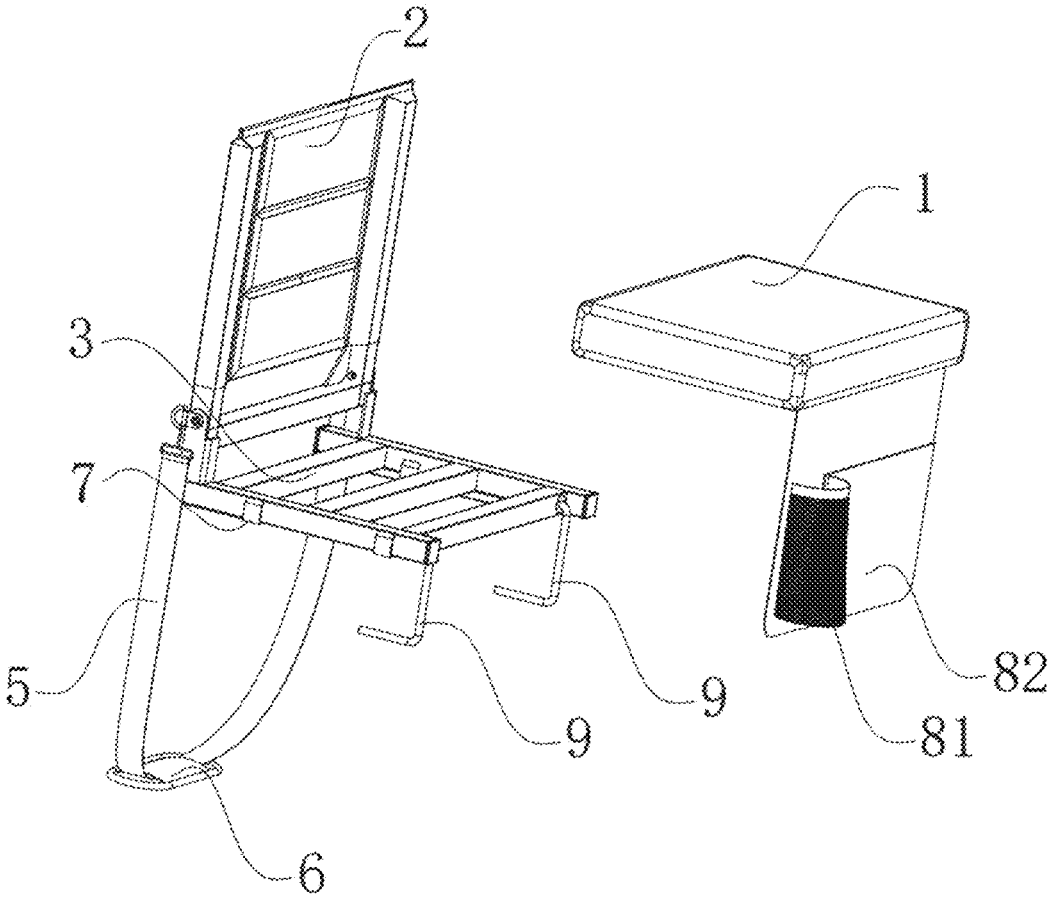
FIG. 7 is a structural diagram of the stadium seat cushion provided by the disclosure after the seat cushion main body is separated from the support frame.

As shown in FIG. 7, in this embodiment, the cover (11) is detachably connected to the support frame (3). If the cover (11) becomes heavily soiled or the contamination is difficult to clean, it can be detached for cleaning. Furthermore, the cover (11) typically encloses the filling material. When the cover (11) is detached, the filling material inside can also be cleaned or replaced. This avoids the need to replace the entire seat cushion main body (1), extending the service life of components and saving costs.

Simultaneously, since the connection between the seat cushion main body (1) and the support frame (3) is detachable, if the seat cushion main body (1) is damaged or the current style no longer meets requirements, the entire seat cushion main body (1) can be directly detached and replaced. Structural components like the backrest (2) and support frame (3) do not need replacement, saving costs. Additionally, during transportation, if space is limited in some areas, the seat cushion main body (1) (cover (11) and internal filling material) can be detached first for separate transportation, improving portability.

At the rear end of the seat cushion main body (1), a connecting member (12) is also provided. Since the backrest (2) provides back support, it needs to be connected to the rear end of the seat cushion main body (1). Therefore, in this embodiment, the backrest (2) is connected to the seat cushion main body (1) via the connecting member (12). Because the backrest (2) is pivotally connected to the seat cushion main body (1), the preferred method of pivotal connection in this embodiment is a shaft-hole fit connection.

As shown in FIG. 5, the connecting member (12) comprises a fixed end (121) and a pin shaft (122). After the support frame (3) is fixedly connected to the seat cushion main body (1), the seat cushion main body (1) receives rigid support from the support frame (3). Therefore, the fixed end (121) is fixedly connected to the support frame (3), the pin shaft (122) is horizontally arranged, and the pin shaft (122) is fixedly connected to the fixed end (121), thereby providing support when the backrest (2) rotates. During connection, the pin shaft (122) is inserted into the lower end of the backrest (2), allowing the backrest (2) to rotate around the pin shaft (122). In different embodiments, the connecting member (12) can take various forms, such as a gear connection, and is not limited to the shaft-hole fit form in this embodiment.

In one embodiment, it further comprises a reinforcing plate (4). One end of the reinforcing plate (4) is connected to the backrest (2), and the other end abuts against the support frame (3).

Referring to FIGS. 1 and 5, since the preferred angle between the backrest (2) and the seat cushion main body (1) is 90°, the reinforcing plate (4) between them is preferably shaped as a right triangle or an isosceles trapezoid. The seat cushion main body (1) is rigidly connected via the support frame (3), so the reinforcing plate (4) is connected between the backrest (2) and the support frame (3). When the backrest (2) enters the support state, it needs to withstand the pressure from the user's back. The backrest (2) is connected to the support frame (3) via the connecting member (12). If the support frame (3) cannot provide sufficient support, the backrest (2) may continue to rotate under the pressure of the back. In this embodiment, the reinforcing plate (4) is provided on the backrest (2) and rotates together with the backrest (2).

When the backrest (2) rotates away from the seat cushion main body (1), it drives the reinforcing plate (4) to rotate until the angle between the backrest (2) and the seat cushion main body (1) reaches 90°, at which point the backrest (2) enters the support state. At this time, the reinforcing plate (4) is driven by the backrest (2) to a position abutting against the support frame (3). Since both the reinforcing plate (4) and the support frame (3) are made of metal materials such as steel or iron, movement is prevented after abutment. This ensures the stability of the backrest (2) support.

In one embodiment, it further comprises a shoulder strap (5) and a cushion pad (6). The shoulder strap (5) is connected to the seat cushion main body (1), and the cushion pad (6) is sleeved on the shoulder strap (5). Please refer to FIGS. 1 to 4 together. The shoulder strap (5) is connected to the rear end of the seat cushion main body (1). When the backrest (2) is rotated to a position flush with the seat cushion main body (1), entering the folded state, the entire backrest (2) and seat cushion main body (1) can be carried away together. Generally, after the backrest (2) and seat cushion main body (1) are flush, they have a certain thickness, making it difficult to carry by hand. However, in this embodiment, the connection via the shoulder strap (5) allows the backrest (2) and seat cushion main body (1) to be carried in a back-carrying or slinging manner, eliminating the need for the user to hold them with both hands, thereby improving portability.

However, because the seat cushion main body (1), backrest (2), and support frame (3) collectively have a certain weight, when carried by the shoulder strap (5) via back-carrying or slinging, the shoulder strap (5) may cause high pressure intensity due to its small contact area. Therefore, in this embodiment, the cushion pad (6) is provided on the shoulder strap (5) to increase the contact area, thereby buffering the pressure, reducing pressure intensity, and improving comfort.

Figure 6:
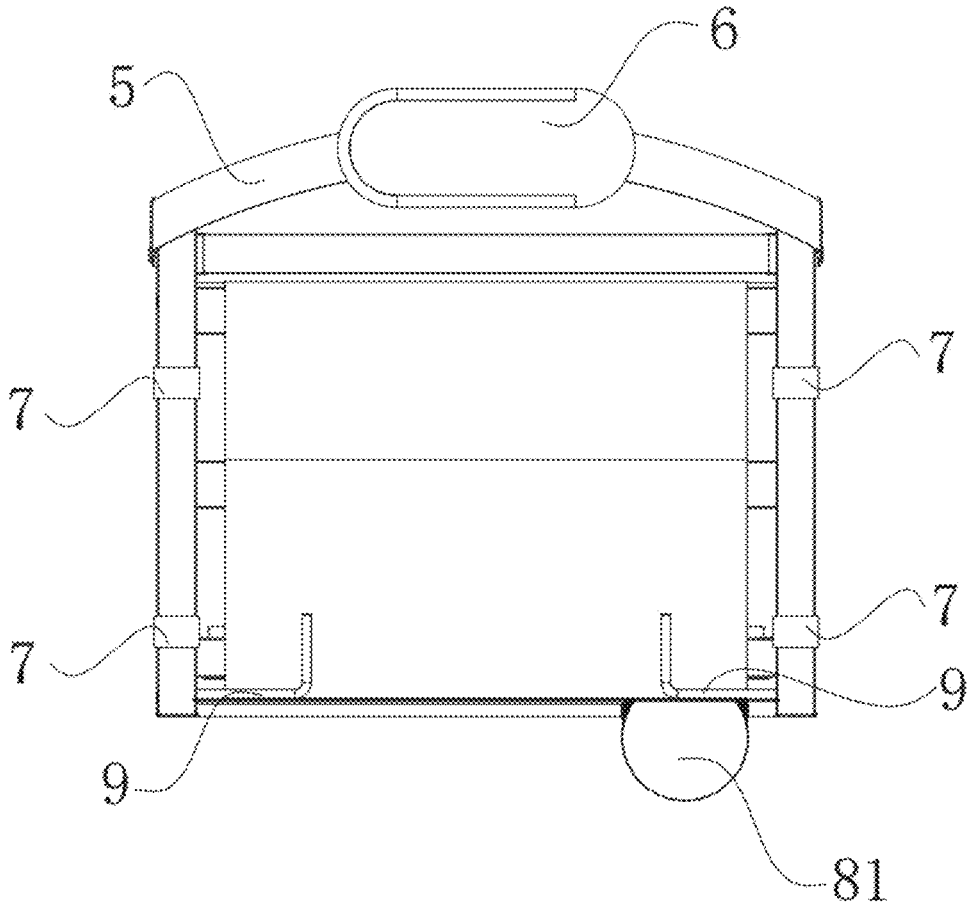
FIG. 6 is a bottom view of the stadium seat cushion provided by the disclosure.

In one embodiment, it further comprises a plurality of anti-slip buckles (7). The plurality of anti-slip buckles (7) are connected to the lower surface of the seat cushion main body (1). Since the support frame (3) is connected below the seat cushion main body (1) in this embodiment, the anti-slip buckles (7) need to be connected below the support frame (3). Preferably, four anti-slip buckles (7) are used as an example in this embodiment. In different embodiments, the number of anti-slip buckles (7) can be increased or decreased, which is not limited here. As shown in FIG. 6, the four anti-slip buckles (7) are symmetrically arranged on the support frame (3), enabling more uniform force distribution on the support frame (3).

Figure 9:
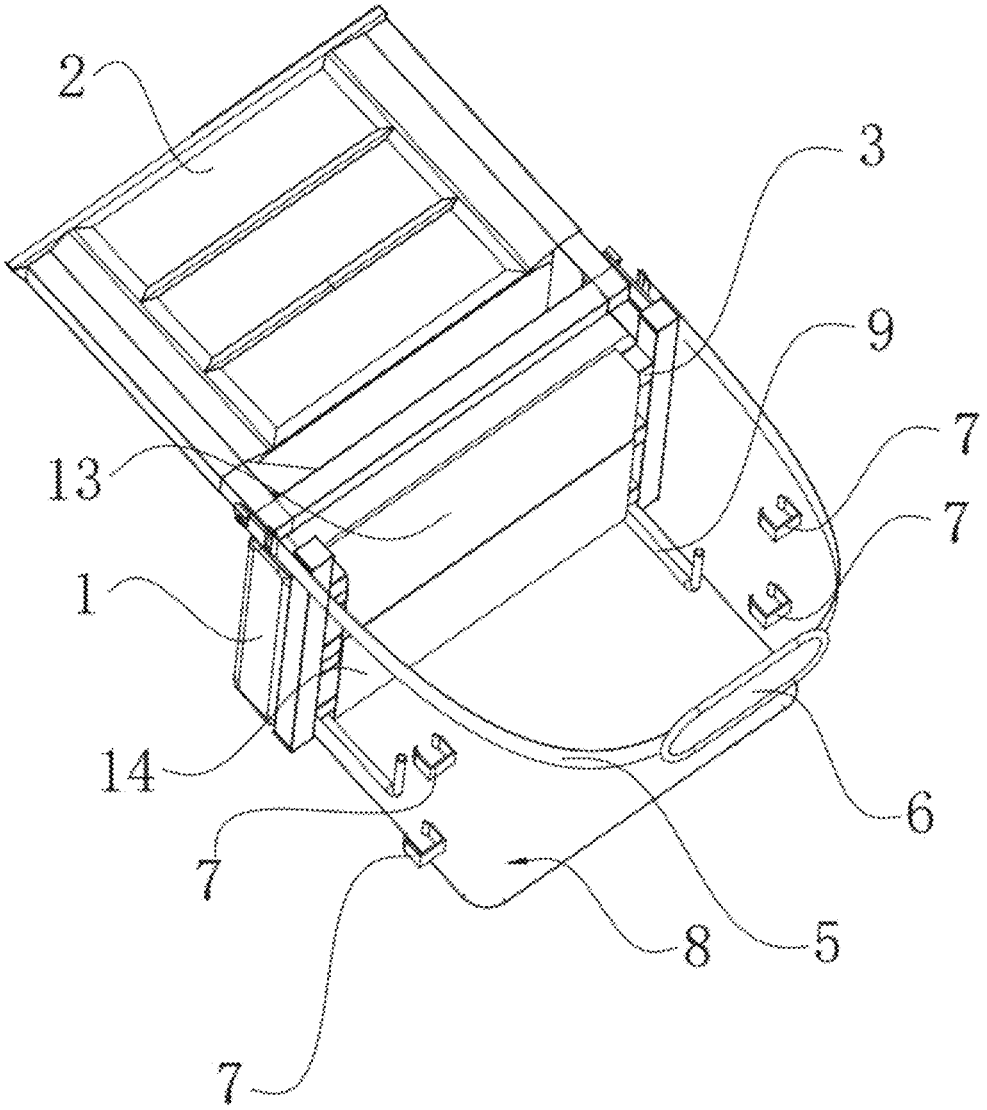
FIG. 9 is a structural diagram of the stadium seat cushion provided by the disclosure after the anti-slip buckle is separated from the support frame.

Because the anti-slip buckles (7) are connected below the support frame (3), when placing the seat cushion main body (1), the anti-slip buckles (7) contact the seat below, separating the support frame (3) from the seat. As shown in FIG. 9, the anti-slip buckles (7) are connected to the support frame (3) via a snap-fit connection, allowing them to be easily detached. If one anti-slip buckle (7) is damaged, that damaged buckle can be replaced individually without needing to replace or disassemble the entire unit, saving time and cost. Moreover, if the bottom friction is insufficient and sliding occurs, the number of anti-slip buckles (7) can be increased. Simply snap additional anti-slip buckles (7) into the bottom of the support frame (3). The entire operation is simple and convenient.

When using the stadium seat cushion provided by this application, the seat cushion main body (1) needs to be placed on the seat provided by the stadium. Generally, seat surfaces are relatively smooth. Smooth surfaces (typically Ra≤1.6 μm) offer advantages such as: 90% lower bacterial adhesion rate compared to rough surfaces (British Medical Journal 2022 study), 3 times higher cleaning efficiency (removing 99% of contaminants with a single wipe), and no residual fabric fibers (reducing allergens by 95% compared to fabric surfaces). Additionally, on smooth surfaces at 23° C.: the thermal conductivity coefficient can be optimized by 15% (avoiding localized overheating), and contact thermal resistance can be reduced to 0.02 $m^2$ K/W (improving winter comfort). Therefore, when the seat cushion main body (1) is placed on a smooth seat surface, insufficient friction may cause the seat cushion main body (1) to slide, leading to instability.

In this embodiment, anti-slip buckles (7) are added below the support frame (3) to increase friction, thereby maintaining the stability of the seat cushion main body (1).

In one embodiment, it further comprises a storage bag (8). The storage bag (8) has a rotational degree of freedom relative to the seat cushion main body (1). In one embodiment, the storage bag (8) comprises a water bottle pocket (81) and a messenger bag (82). In one embodiment, the storage bag (8) is made of flexible material.

Figure 2:
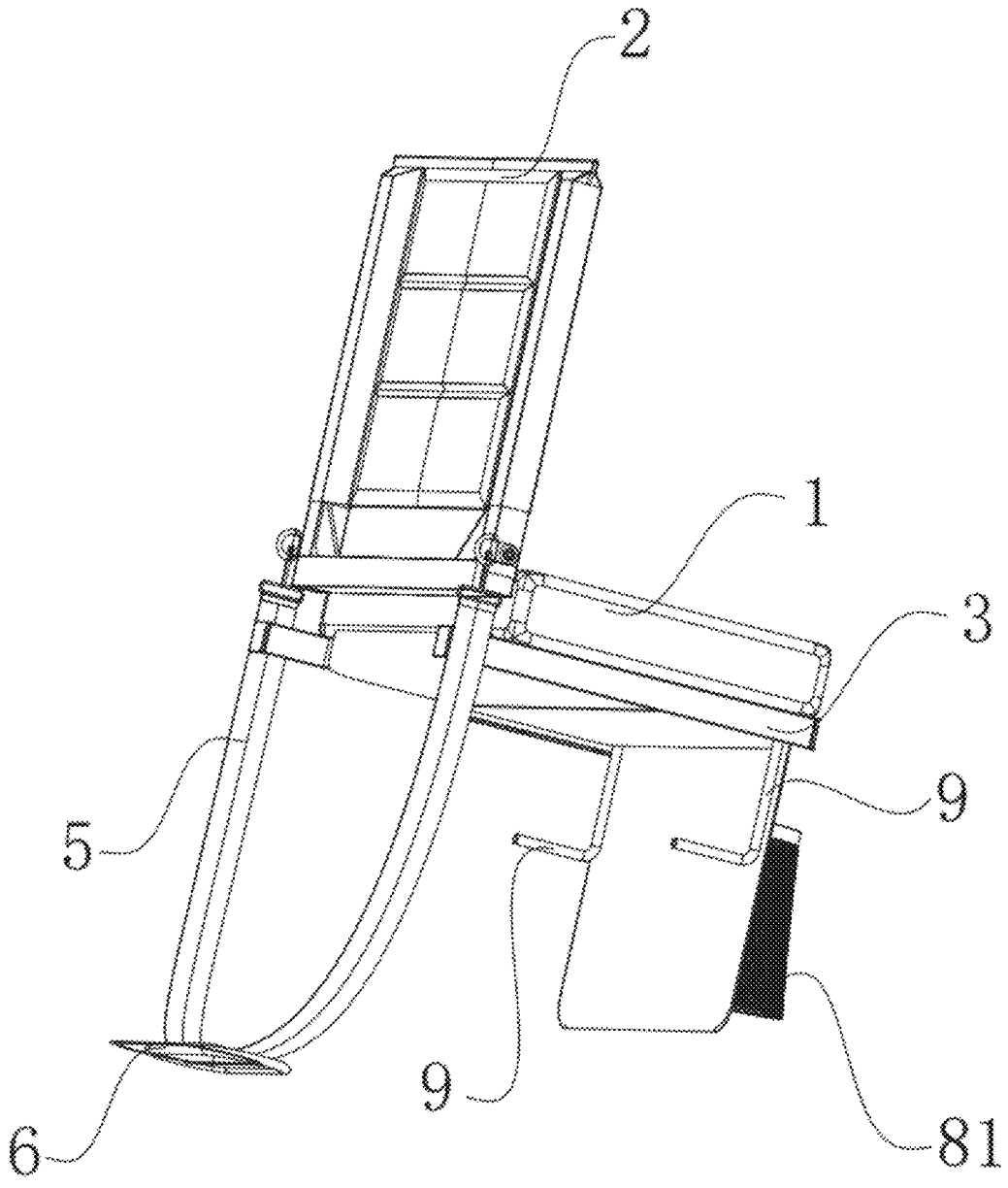
FIG. 2 is a left-side structural diagram of the stadium seat cushion provided by the disclosure.
Figure 3:
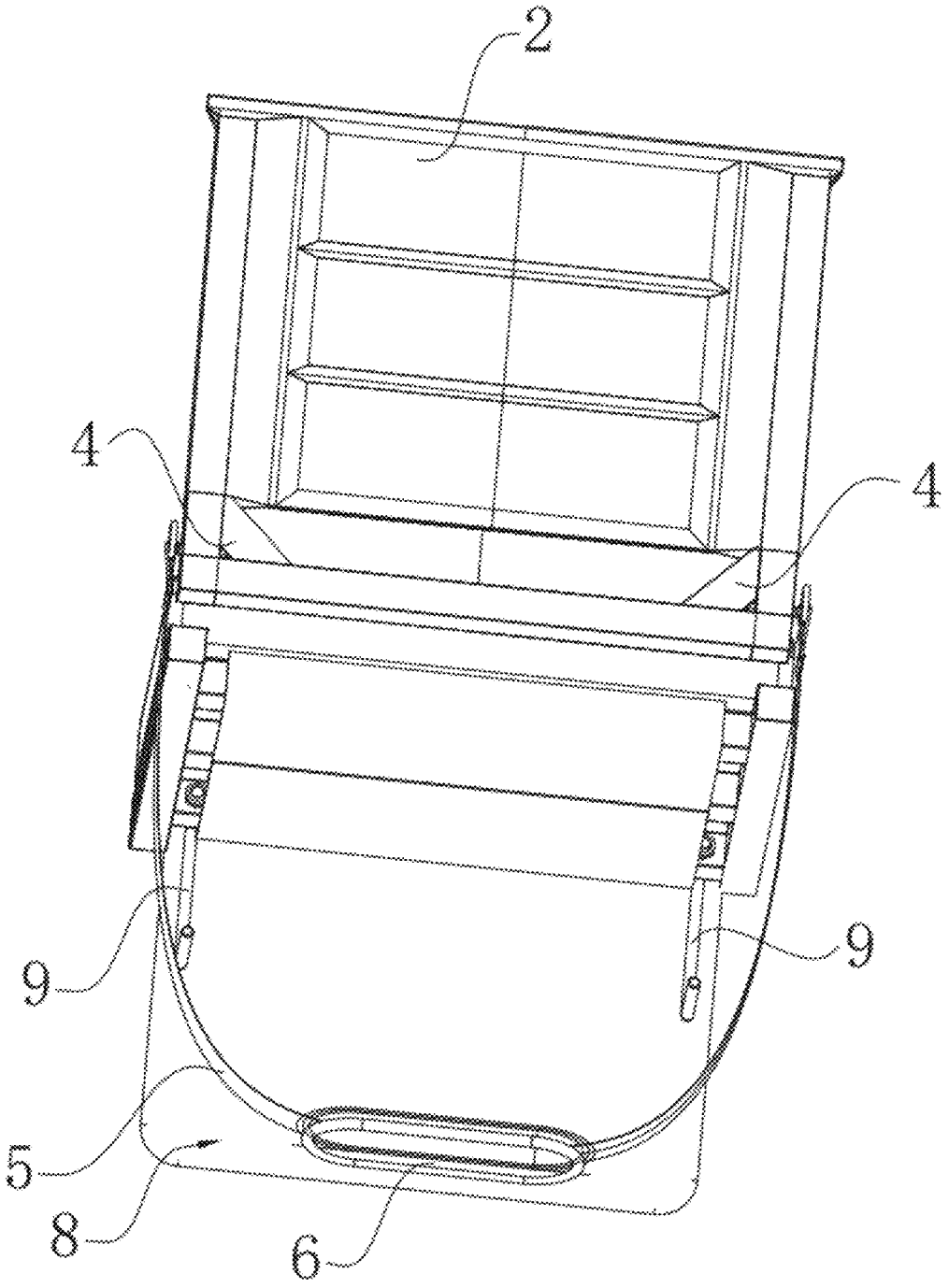
FIG. 3 is a rear-side structural diagram of the stadium seat cushion provided by the disclosure.

Referring to FIGS. 1 and 2, the storage bag (8) is connected at the front end of the seat cushion main body (1). Because during games or performances in the stadium, the user is typically seated, positioning the storage bag (8) at the front end of the seat cushion main body (1) makes access more convenient. Moreover, under gravity, the storage bag (8) hangs down naturally. At this point, the storage bag (8) is positioned near the user's legs, making it easier to retrieve items from it. Users often carry various types of items during performances, so in this embodiment, the storage bag (8) includes a water bottle pocket (81) and a messenger bag (82). The water bottle pocket (81) is designed to fit the shape of a water bottle, conforming better to its outer surface, making the bottle more secure once placed inside. The messenger bag (82) can store other items. Since the messenger bag (82) opens and closes via hook-and-loop fasteners, it protects the safety of the stored items. Furthermore, the messenger bag (82) can be compressed or expanded, increasing its internal storage capacity.

Furthermore, the storage bag (8) is pivotally connected to the seat cushion main body (1). When the backrest (2) enters the folded state, the entire unit needs to be folded to reduce volume for easy transportation. Therefore, with the storage bag (8) pivotally connected to the seat cushion main body (1), the storage bag (8) can also be rotated to a position flush with the seat cushion main body (1), achieving volume reduction. The backrest (2) is flush with the upper surface of the seat cushion main body (1), and the storage bag (8) naturally hangs down below, flush with the lower surface of the seat cushion main body (1). In this embodiment, making the storage bag (8) from flexible material allows it to rotate more easily and further reduces its volume. During transportation, the soft storage bag (8) has more deformation space, making it more adaptable to different storage spaces and improving applicability.

As shown in FIG. 7, the storage bag (8) is connected to the seat cushion main body (1), so when detaching the seat cushion main body (1), the storage bag (8) can be detached together for cleaning. Then, folding the storage bag (8) below the seat cushion main body (1) can further reduce the volume of the entire assembly. Dividing the stadium seat cushion into two parts for separate transportation can reduce transportation and storage costs.

In one embodiment, it further comprises a hook (9). The hook (9) is connected below the seat cushion main body (1), for fixing the seat cushion main body (1). In one embodiment, the hook (9) has a rotational degree of freedom relative to the seat cushion main body (1).

Figure 4:
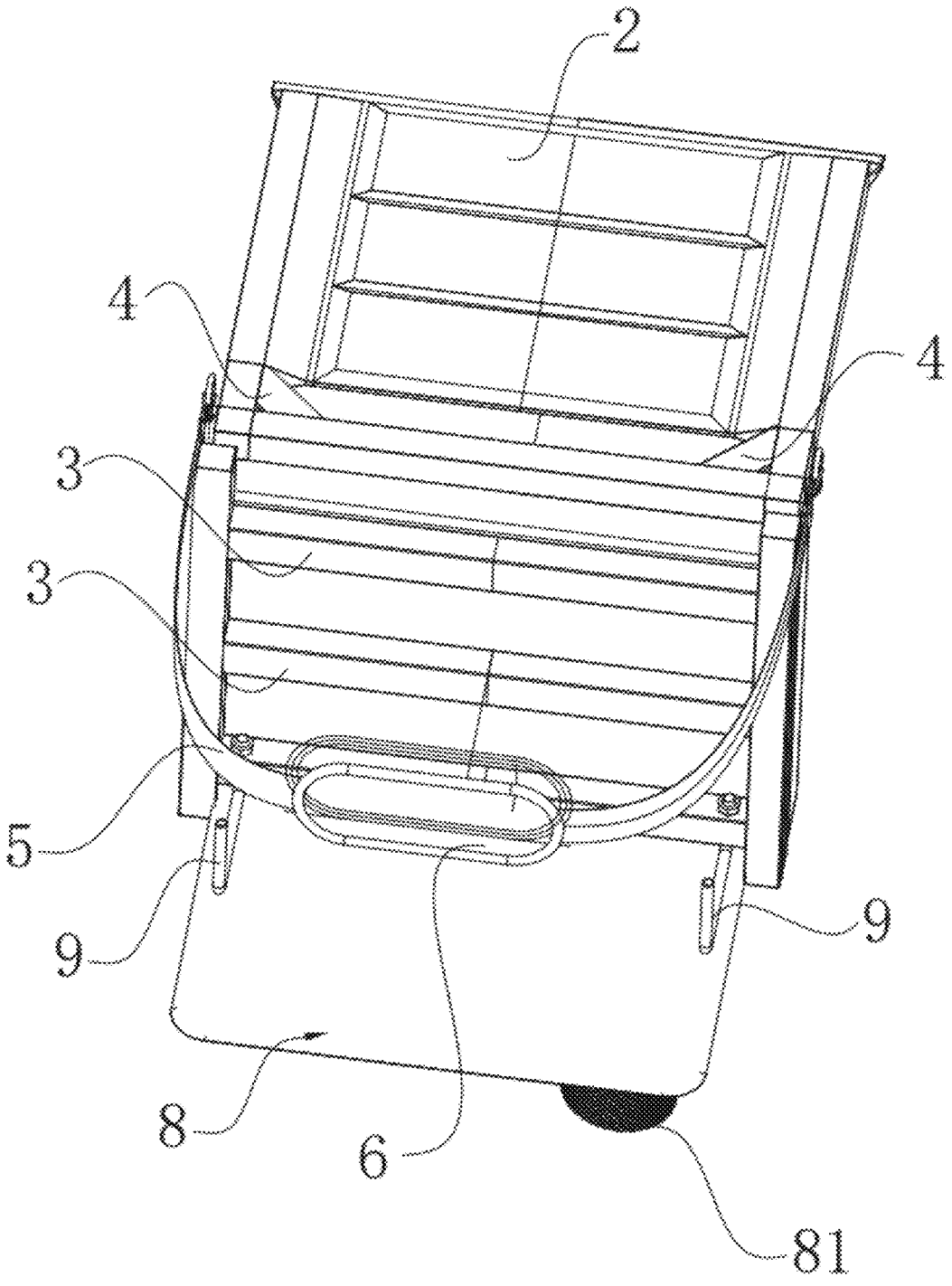
FIG. 4 is a structural diagram of the stadium seat cushion provided by the disclosure after the bottom cover is removed.

Referring to FIGS. 2 and 4, the hook (9) is approximately "L"-shaped. Preferably, this embodiment has two hooks (9), symmetrically arranged on both sides of the seat cushion main body (1), positioned below the front end of the seat cushion main body (1). The support frame (3) is connected below the seat cushion main body (1), so the two hooks (9) are connected to the support frame (3). When the seat cushion main body (1) is placed on a seat, the seat has a certain thickness. The hooks (9) below the seat cushion main body (1) can clamp onto the seat using the groove formed between themselves and the seat cushion main body (1), further enhancing the stability of the seat cushion main body (1). The symmetrical arrangement of the two hooks (9) enables more uniform force distribution on the seat cushion main body (1).

Simultaneously, the hooks (9) are positioned below the seat cushion main body (1). During transportation, the storage bag (8) needs to be rotated below and flush with the seat cushion main body (1). At this time, the hooks (9) are also below the seat cushion main body (1), so they would push against the storage bag (8), preventing it from lying flush with the lower surface of the seat cushion main body (1), increasing the overall volume and making transportation difficult.

Therefore, in this embodiment, the hooks (9) are pivotally connected to the seat cushion main body (1). As shown in FIG. 6, when transportation is needed, first rotate both hooks (9) to a position flush with the lower surface of the seat cushion main body (1), then rotate and attach the storage bag (8). This reduces the overall volume and simplifies the folding process.

Figure 8:
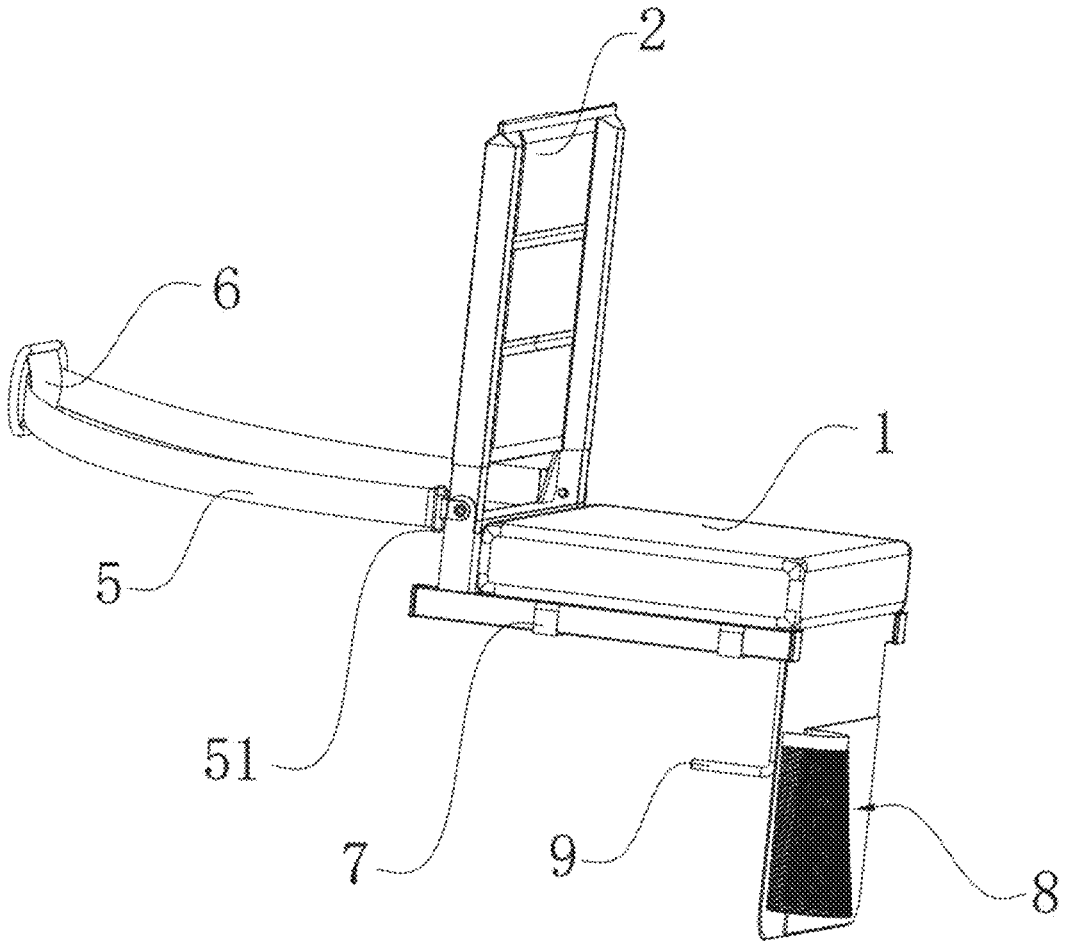
FIG. 8 is a structural diagram of a stadium seat cushion provided by another embodiment of the disclosure.

As shown in FIG. 8, this application also provides another structure for connecting the shoulder strap (5) to the seat cushion main body (1). The shoulder strap (5) comprises a connecting buckle (51), which is rectangular. The shoulder strap (5) is connected to the seat cushion main body (1) via the connecting buckle (51).

In one embodiment, it further comprises a first connecting strap (13) and a second connecting strap (14). The first connecting strap (13) and the second connecting strap (14) are respectively connected to the two ends below the seat cushion main body (1). The first connecting strap (13) and the second connecting strap (14) are detachably connected to each other. The support frame (3) is provided between the seat cushion main body (1) and the first connecting strap (13) as well as the second connecting strap (14).

Figure 10:
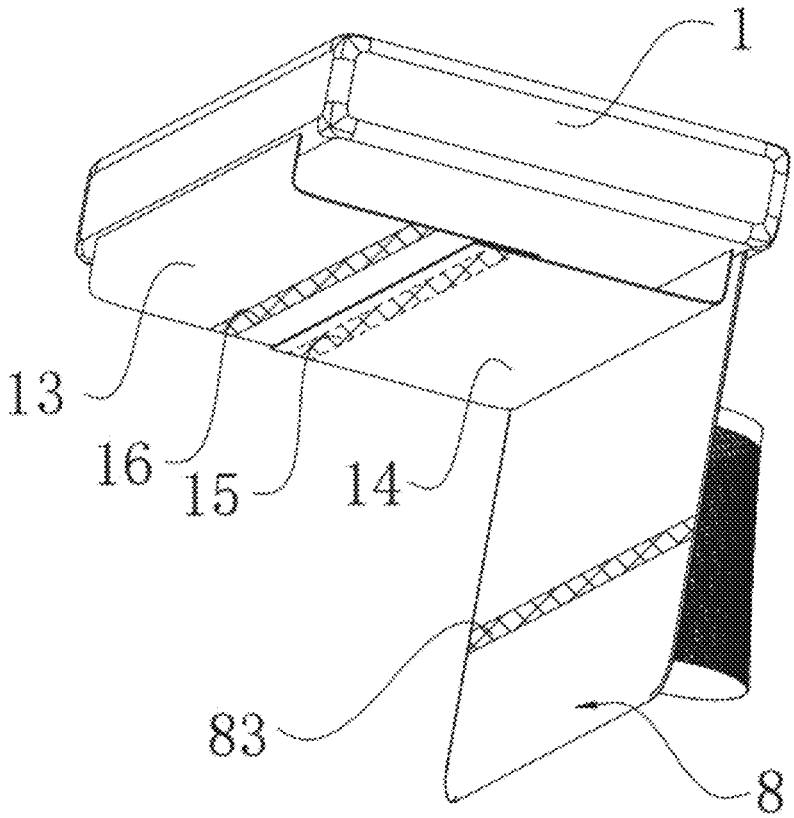
FIG. 10 is a schematic diagram showing the connection of the first connecting strap and the second connecting strap provided by the disclosure.
Figure 11:
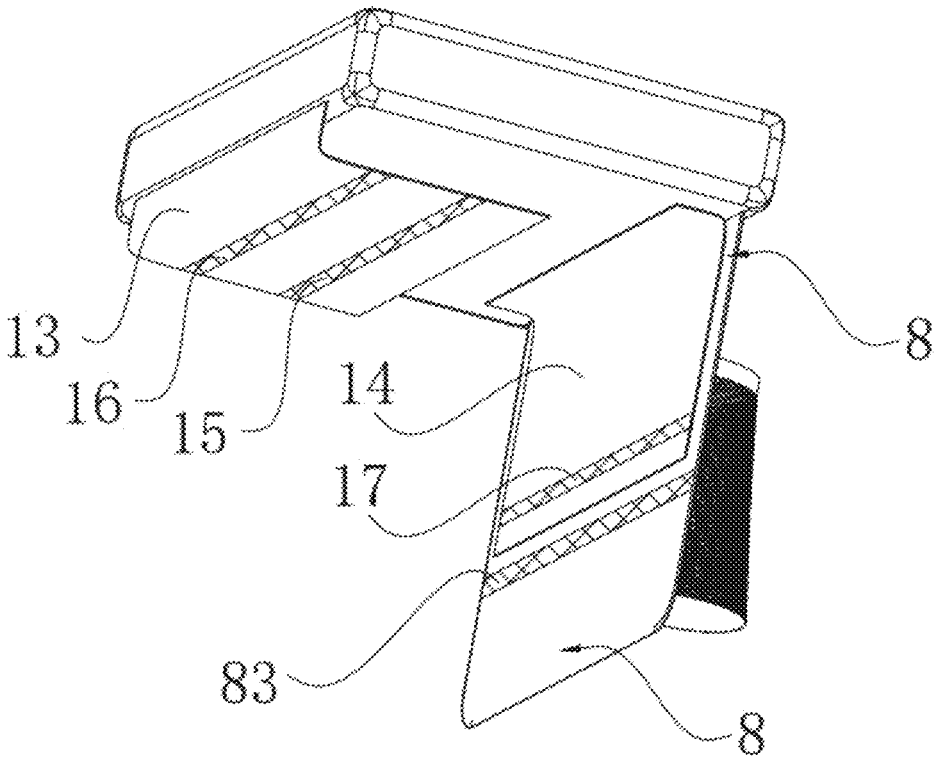
FIG. 11 is a schematic diagram showing the first connecting strap and the second connecting strap provided by the disclosure after disconnection.

Referring to FIGS. 9 to 11, preferably, the first connecting strap (13) and the second connecting strap (14) are respectively connected to the front and rear ends below the seat cushion main body (1). Moreover, the first connecting strap (13) and the second connecting strap (14) are also preferably made of flexible material. As shown in FIG. 10, after connecting the first connecting strap (13) and the second connecting strap (14) together, they form a single unit. Together with the seat cushion main body (1) above, they form a fixed space. The support frame (3) is located below the seat cushion main body (1), and the first connecting strap (13) and second connecting strap (14) are below the support frame (3). Therefore, the support frame (3) is fixed between the seat cushion main body (1) and the first and second connecting straps (13, 14). The connection of the straps keeps the support frame (3) relatively fixed to the seat cushion main body (1).

As shown in FIG. 11, because the first connecting strap (13) and the second connecting strap (14) are made of flexible material, after detaching them, the seat cushion main body (1) can be separated from the support frame (3), facilitating cleaning of the seat cushion main (1). Simultaneously, the first connecting strap (13), second connecting strap (14), and storage bag (8) are all connected to the seat cushion main body (1), so the seat cushion main body (1) can be detached carrying these components together for cleaning or replacement.

In one embodiment, the first connecting strap (13) is provided with a first fixing strip (15) and a second fixing strip (16). The second connecting strap (14) is provided with a first connecting strip (17). The first connecting strip (17) is detachably connected to the first fixing strip (15). The storage bag (8) is provided with a second connecting strip (83). The second connecting strip (83) is detachably connected to the second fixing strip (16).

Referring to FIGS. 10 and 11, in this embodiment, the connection between the first connecting strap (13) and the second connecting strap (14) is detachable. Therefore, the first connecting strap (13) has the first fixing strip (15), and the second connecting strap (14) has the first connecting strip (17). Aligning and connecting the first fixing strip (15) and the first connecting strip (17) detachably connects the first and second connecting straps (13, 14). Preferably, hook-and-loop fasteners (e.g., Velcro) are used in this embodiment for the detachable connection. Thus, one of the first fixing strip (15) and the first connecting strip (17) corresponds to the hook side, and the other to the loop side, achieving detachable connection via adhesion.

As mentioned earlier, the storage bag (8) can be folded below the seat cushion main body (1). However, being made of flexible material, if improperly positioned after folding, the storage bag (8) might slip down under gravity, causing great inconvenience. In this embodiment, as shown in FIG. 11, the first connecting strap (13) also has a second fixing strip (16), and the storage bag (8) has a second connecting strip (83). Moreover, one of the second fixing strip (16) and the second connecting strip (83) corresponds to the hook side, and the other to the loop side. Therefore, when folding the storage bag (8) below the seat cushion main body (1), they can be adhered together via the second fixing strip (16) and the second connecting strip (83), keeping the storage bag (8) fixed after folding. Since the connection between the second fixing strip (16) and the second connecting strip (83) is detachable, the storage bag (8) can be detached for use when needed. The overall process is simple and convenient, preserving the storage function of the bag while ensuring the stability of its folded position.

Finally, it should be noted that: the above embodiments are only used to illustrate the technical solutions of the disclosure, not to limit them; although the disclosure has been described in detail with reference to the foregoing embodiments, those of ordinary skill in the art should understand that they can still modify the technical solutions described in the foregoing embodiments or equivalently replace some of the technical features; such modifications or replacements do not cause the essence of the corresponding technical solutions to depart from the spirit and scope of the technical solutions of the embodiments of the disclosure.

What is claimed is:

1. A stadium seat cushion, comprising:

a seat cushion main body (1) and a backrest (2); the seat cushion main body (1) having filling material inside, the backrest (2) being pivotally connected to the seat cushion main body (1); the backrest (2) including a support state and a folded state; wherein, when the backrest (2) is in the folded state, rotating the backrest (2) away from the seat cushion main body (1) causes it to enter the support state; when the backrest (2) is in the support state, rotating the backrest (2) to a position flush with the seat cushion main body (1) causes it to enter the folded state;

a support frame (3); the support frame (3) being connected to a lower surface of the seat cushion main body (1);

a storage bag (8); the storage bag (8) being installed at a front of the seat cushion main body (1), and the storage bag (8) having a rotational degree of freedom relative to the seat cushion main body (1); and a first connecting strap (13) and a second connecting strap (14); the first connecting strap (13 and the second connecting strap (14) being respectively connected to two ends below the seat cushion main body (1); the first connecting strap (13) and the second connecting strap (14) being detachably connected to each other; and the support frame (3) being provided between the seat cushion main body (1) and the first connecting strap (13) as well as the second connecting strap (14).

2. The stadium seat cushion of claim 1, wherein the storage bag (8) is made of flexible material.

3. The stadium seat cushion of claim 1, wherein the seat cushion main body (1) comprises a cover (11) and a connecting member (12); the cover (11) is detachably connected to the support frame (3); the connecting member (12) is provided at a rear end of the seat cushion main body (1); and the backrest (2) is pivotally connected to the seat cushion main body (1) through the connecting member (12).

4. The stadium seat cushion of claim 1, further comprising a reinforcing plate (4); one end of the reinforcing plate (4) being connected to the backrest (2), and in the support state, another end of the reinforcing plate (4) abutting against the support frame (3).

5. The stadium seat cushion of claim 1, further comprising a shoulder strap (5) and a cushion pad (6); the shoulder strap (5) being connected to the seat cushion main body (1); the cushion pad (6) being sleeved on the shoulder strap (5).

6. The stadium seat cushion of claim 1, further comprising a plurality of anti-slip buckles (7); the plurality of anti-slip buckles (7) being detachably connected to the lower surface of the seat cushion main body (1).

7. The stadium seat cushion of claim 1, wherein the first connecting strap (13) is provided with a first fixing strip (15) and a second fixing strip (16); the second connecting strap (14) is provided with a first connecting strip (17); the first connecting strip (17) is detachably connected to the first fixing strip (15); the storage bag (8) is provided with a second connecting strip (83); and the second connecting strip (83) is detachably connected to the second fixing strip (16).

8. The stadium seat cushion of claim 1, wherein the storage bag (8) comprises a water bottle pocket (81) and a messenger bag (82).

9. The stadium seat cushion of claim 1, further comprising a hook (9), the hook (9) being connected below the seat cushion main body (1), for fixing the seat cushion main body (1).

10. The stadium seat cushion of claim 9, wherein the hook (9) has a rotational degree of freedom relative to the seat cushion main body (1).

* * * * *